US005393086A

United States Patent [19]

Le Masson et al.

[11] Patent Number: 5,393,086

[45] Date of Patent: Feb. 28, 1995

[54] SKI FOR WINTER SPORTS COMPRISING A BASE, A STIFFENER AND A SUPPORT FOR BINDINGS

[75] Inventors: Jacques Le Masson, Cran-Gevrier; Philippe Commier, Annecy, both of France

[73] Assignee: Salomon, S.A., Annecy Cedex, France

[21] Appl. No.: 144,543

[22] Filed: Oct. 26, 1993

Related U.S. Application Data

[63] Continuation of Ser. No. 802,279, Dec. 4, 1991, abandoned.

[30] Foreign Application Priority Data

Dec. 14, 1990 [FR] France ..... 90 16048
Apr. 16, 1991 [FR] France ..... 91 05012

[51] Int. Cl.[6] ..... A63C 5/07

[52] U.S. Cl. ..... 280/602; 280/607; 280/609

[58] Field of Search ..... 280/602, 607, 609, 610, 280/634, 636, 601

[56] References Cited

U.S. PATENT DOCUMENTS

| | | | |
|---|---|---|---|
| 2,196,925 | 4/1940 | Kairis | 280/607 |
| 2,258,046 | 10/1941 | Clement | 280/602 |
| 3,260,532 | 7/1966 | Heuvel | 280/11.13 |
| 3,398,968 | 8/1968 | Mutzhas | 280/11.13 |
| 3,937,481 | 2/1976 | Koleda | 280/11.35 |
| 4,577,886 | 3/1986 | Chernega | 280/602 |
| 4,696,487 | 9/1987 | Girard | 280/602 |
| 4,697,820 | 10/1987 | Hayashi et al. | 280/602 |
| 4,804,200 | 2/1989 | Kuchler | 280/607 |
| 4,896,895 | 1/1990 | Bettosini | 280/607 |
| 4,903,979 | 2/1990 | Dimier | 280/628 |
| 4,974,867 | 12/1990 | Rullier et al. | 280/607 |
| 5,035,442 | 7/1991 | Arnsteiner | 280/602 |
| 5,129,668 | 7/1992 | Hecht | 280/607 |
| 5,251,923 | 10/1993 | Stepanek et al. | 280/607 |
| 5,269,555 | 12/1993 | Ruffinengo | 280/602 |
| 5,280,942 | 1/1994 | Ruffinengo | 280/602 |

FOREIGN PATENT DOCUMENTS

| | | |
|---|---|---|
| 373786 | 2/1984 | Austria . |
| 376571 | 12/1984 | Austria . |
| 0104185 | 3/1983 | European Pat. Off. . |
| 0409749 | 7/1990 | European Pat. Off. . |
| 0460574 | 12/1991 | European Pat. Off. . |
| 0492658 | 7/1992 | European Pat. Off. . |
| 0564767 | 10/1993 | European Pat. Off. . |
| 810762 | 3/1937 | France . |
| 1118857 | 6/1956 | France . |
| 1269049 | 6/1961 | France . |
| 1407710 | 6/1965 | France . |
| 1433242 | 2/1966 | France . |
| 1467141 | 1/1967 | France . |
| 2433350 | 3/1980 | France . |
| 2654636 | 5/1991 | France . |
| 1578852 | 3/1971 | Germany . |
| 1603002 | 8/1971 | Germany . |
| 2135450 | 4/1972 | Germany . |
| 2259375 | 6/1974 | Germany . |
| 7912699 | 5/1979 | Germany . |
| 3933717 | 4/1990 | Germany . |
| WO83/03360 | 10/1983 | WIPO . |
| 8604824 | 8/1986 | WIPO . |
| WO8801190 | 2/1988 | WIPO . |
| WO88/05324 | 7/1988 | WIPO . |
| 9003205 | 4/1990 | WIPO . |

*Primary Examiner*—Richard M. Camby
*Attorney, Agent, or Firm*—Sandler, Greenblum & Bernstein

[57] ABSTRACT

A ski having a first lower assembly or base whose front end is raised to form the spatula, and a second upper assembly or stiffener whose front and rear ends are connected to the base by a flexible and/or partially rigid connection, and includes at least one support or stirrup connected to the base adapted to receive the bindings in order to maintain the boot on the ski.

44 Claims, 17 Drawing Sheets

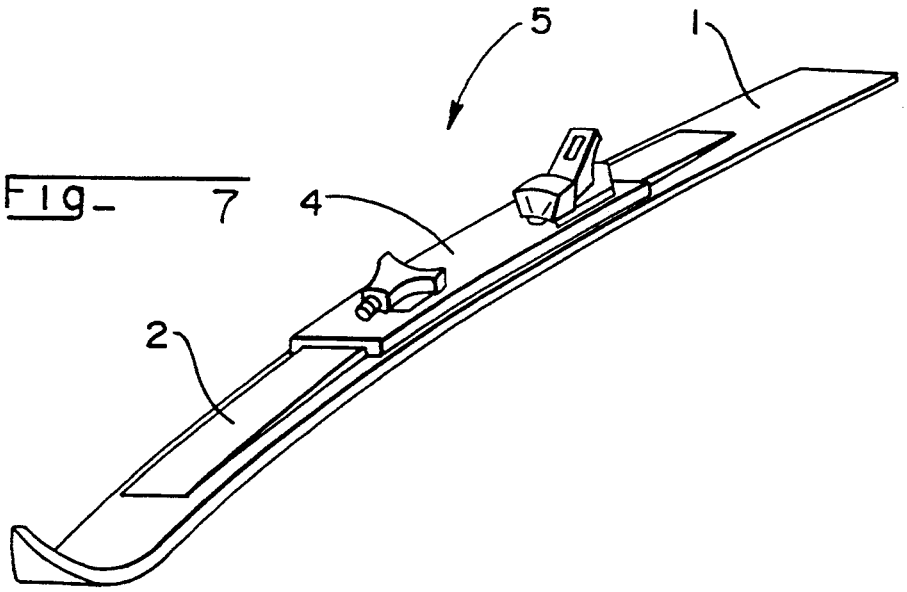
Fig- 7
Fig- 8
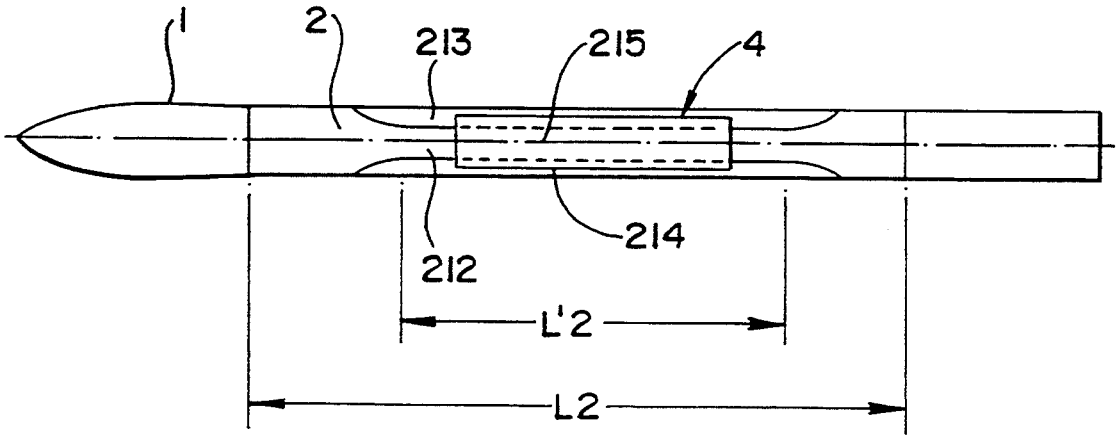

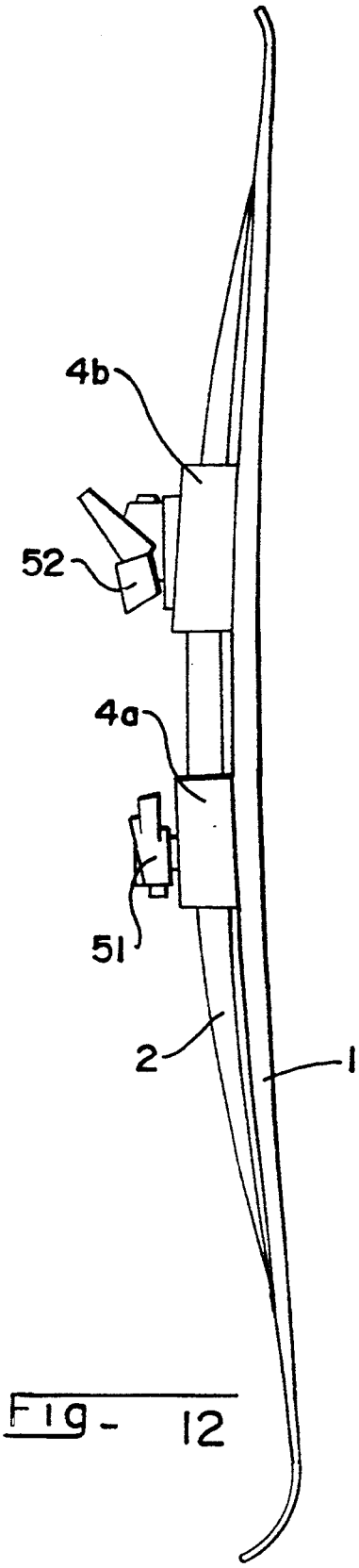
Fig- 12
Fig- 15
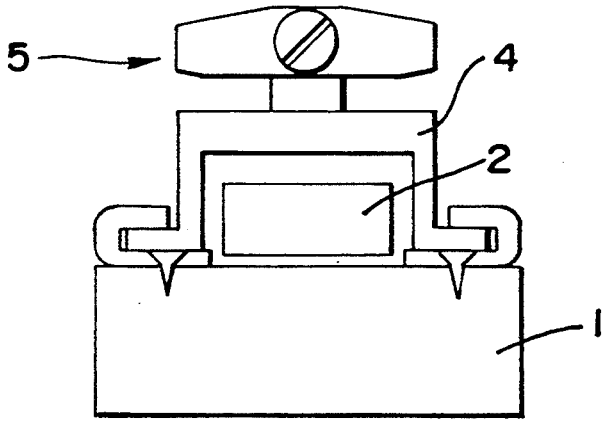
Fig- 13
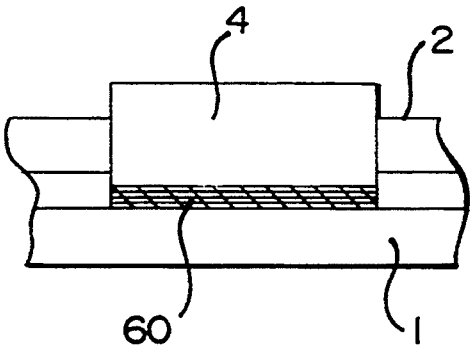
Fig- 14
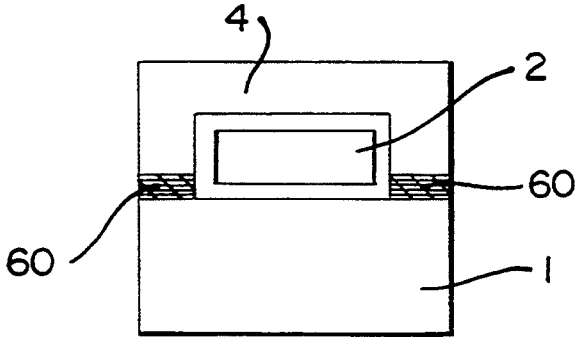

SKI FOR WINTER SPORTS COMPRISING A BASE, A STIFFENER AND A SUPPORT FOR BINDINGS

This application is a continuation of application Ser. No. 07/802,279, filed Dec. 4, 1991, now abandoned.

BACKGROUND OF THE INVENTION

1. Field of the Invention

The present invention relates to a ski, such as an alpine ski, a cross country ski, a monoski or a snowboard. It is related, more particularly to an improvement of this type of ski.

2. Description of Background and Relevant Information

Many different types of skis are already known, and these skis have numerous variations. They are constituted by a beam of an elongated shape, whose front end is curved upwardly to constitute a spatula, the rear end also being slightly curved to constitute the heel.

Currently known skis generally have a composite structure, in which different materials are combined, such that each of them intervenes in an optimal manner, with respect to the distribution of mechanical stresses during use of the ski. Thus, the structure generally comprises peripheral protection elements, internal resistance elements to resist flexion and torque stresses and a core. These elements are assembled by adhesion or by injection, the assembly generally being hot formed in a mold that has the definitive shape of the ski, with a front portion substantially raised in a spatula, a rear portion slightly raised at the heel, and an arched central portion.

Despite ski manufacturers' concerns regarding the manufacture of good quality skis, they have not, until now, been able to produce high performance skis that are satisfactory under all circumstances.

SUMMARY OF THE INVENTION

The present invention concerns improvements to these skis, having the object of facilitating their manufacture, that enables the desired characteristics to be obtained by virtue of the diversity of the parameters that may be chosen.

The ski according to the invention comprises a first lower assembly or base and a second upper assembly or stiffener, whose front and rear ends are connected to the base by flexible and/or partially rigid connection means, and include at least one support or stirrup connected to the base adapted to receive bindings in order to maintain the boot on the ski.

According to an advantageous configuration, the stiffener has a length smaller than the length of the surface of the base in contact with the snow.

According to a complementary characteristic, the base and/or the stiffener is a beam of an elongated shape.

According to the invention, the stiffener is linked to the base by a connection localized at its two ends, and this connection is flexible and/or partially rigid.

According to a preferred embodiment, the support has the shape of a stirrup, in the shape of an inverted "U", and comprises an upper wall extending laterally and downwardly by two sidewalls to constitute a lower housing having the shape of a hollow section extending longitudinally and adapted for the passage of the stiffener. The support may receive the front binding in the front, and extend towards the rear up under the rear binding. The ski can be such that it comprises two supports, distanced from one another, a first front support on which the front abutment for retention of the boot is fixed, and a second support or a rear support on which the heel attachment is fixed.

BRIEF DESCRIPTION OF THE DRAWINGS

Other characteristics and advantageous of the invention will become more apparent from the description that follows, in light of the annexed drawings, that are given as non-limiting examples only.

FIG. 7 is a perspective view;

FIG. 8 is a top view representing a variation.

FIG. 12 is a lateral view illustrating another embodiment;

FIGS. 13 and 14 represent a variation according to partial schematic views, respectively lateral and sectional;

FIG. 15 is a transverse sectional view illustrating a variation;

FIG. 27 is a lateral view of an equipped ski;

FIG. 28 is a sectional view along T3 of FIG. 27;

FIG. 29 is a sectional view along T4 of FIG. 27;

FIG. 30 is a perspective view of FIG. 27;

FIGS. 32 and 33 are simplified transverse sectional views according to a variation of FIG. 6;

FIG. 34 is a longitudinal sectional view in the support zone of FIG. 33;

DETAILED DESCRIPTION OF PREFERRED EMBODIMENTS

Figure 1:
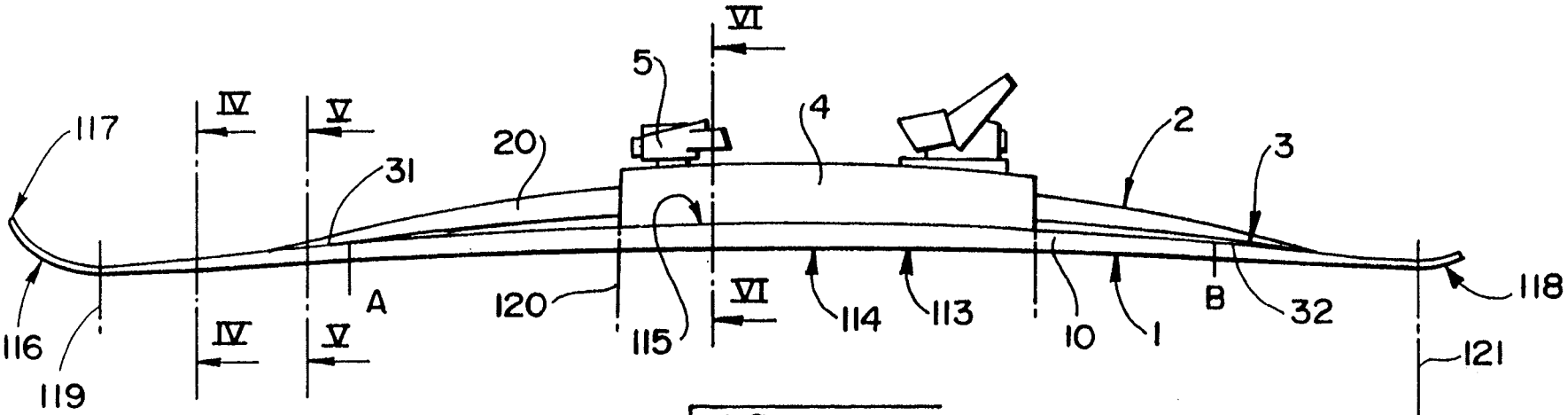
FIG. 1 is a lateral view of a first embodiment of a ski according to the invention.

FIG. 1 represents a ski according to a first embodiment of the invention. It comprises a lower assembly or base 1, and an upper assembly or stiffener 2. The stiffener 2 is located above the base 1, and is connected to the latter by connecting means 3.

The base 1 is the element that is in contact with the snow, and has the shape of an elongated beam 10, having its own distribution of thickness, of width, and thus of its rigidity. This elongated beam may also, however, have a rigidity less or equal to that of a traditional ski.

The base 1 comprises a central portion 113, slightly arched, having a lower sliding surface 114, and an upper surface 115. The central portion 113 occupies the greatest portion of the length of the base, and extends, on the one hand, frontwardly by a front part 116, raised to form the spatula 117, and on the other hand, by a rear part 118, slightly raised to form the heel of the ski. The rear part 118 having a relatively smaller length, and being relatively less raised, and the front part 116 being longer and much more arched, as is well-known, and represented in the drawings.

Figure 4:
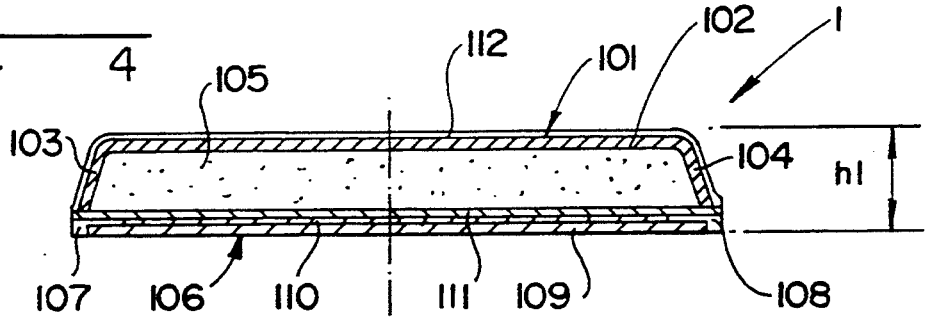
FIGS. 4, 5, and 6 are sections along IV—IV, V—V, VI—VI of FIG. 1.
Figure 5:
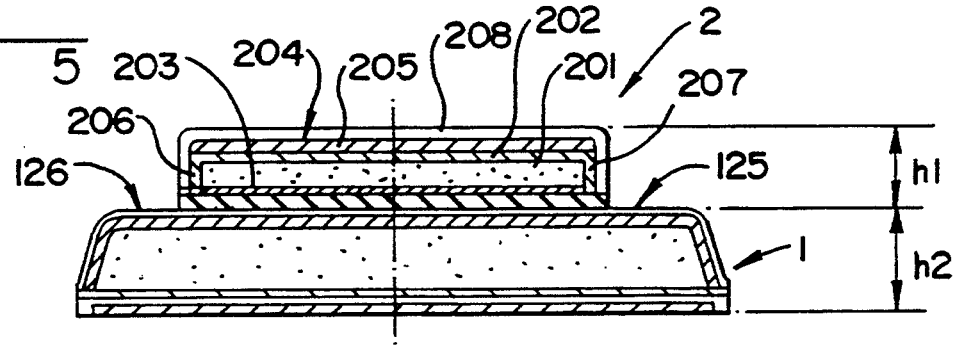
Figure 6:
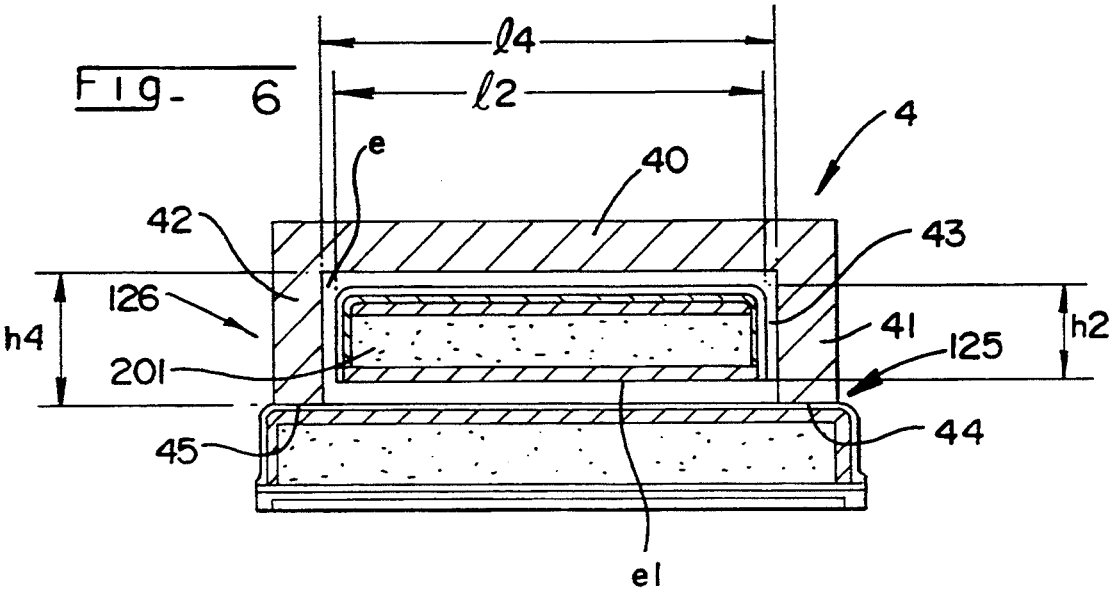

The structure of base 1 may be of the sandwich type, or of the box type, or of any other type. In FIGS. 4, 5, and 6, a preferred structure is represented, comprising a rigid upper reinforcement 101, shaped like a shell with a "U" shaped section forming an upper wall 102, and two sidewalls 103 and 104, covering a core 105, the assembly being closed at its lower portion by a lower element 106, comprising metallic running edges 107,108, a sliding layer 109, generally made of polyethylene, as well as lower reinforcement elements 110, 111. An upper superficial layer 112 covers the upper reinforcement to form the decor of the base.

The reinforcement layers 101, 110, 111 may be of any type, such as layers of composite material like fiberglass, carbon fiber with epoxy resin or polyester or be made of a metallic alloy.

The core 105 may be of foam, filled or not, with wood or an aluminum honey comb.

The single layer or multi-layer superficial layer ensuring the decor may be of polyamide or any other material, such as a thermoplastic material.

According to one of the characteristics of the invention, the upper surface 115 of the central portion 113 of the base 1 is covered with a stiffener 2. This element is adapted to complete the distribution of the rigidity of base 1, so as to obtain the desired general distribution. The stiffener 2 may be of any type, of any shape, and of any structure.

According to an advantageous embodiment, the stiffener 2 has the shape of an extended portion 20, that also has its own distribution of thickness, width, and thus of rigidity.

In the embodiment given as an example, and represented in FIGS. 5 and 6, the structure of the stiffener is of the box type, and is formed by a core 201, positioned between an upper reinforcement 202 and lower reinforcement 203. It may also be constituted of a simple section, or a wing for example.

The upper reinforcement 202 is covered by another additional reinforcement layer 204, in the shape of an inverted "U" and forming an upper wall 205, and two sidewalls 206, 207. A superficial layer 208 covers the top and the lateral surfaces of the stiffener 2, to form the finishing and the decor of this element.

As was the case previously for the base, the reinforcement layers of the stiffener may be of any type, such as layers of composite materials like fiberglass, carbon fiber, with epoxy resin or polyester. The core 201 may be of a foam, reinforced or not, with wood or an aluminum honey comb. The superficial layers ensuring decor may be of polyamide or any other material, such as a thermoplastic material. It may be single-layered, or be made of several layers.

According to an advantageous configuration, the stiffener 2 has length "L2" smaller than length "L1" of the base 1. Thus, the front end 209 of the stiffener is located between the spatula contact point 119 of the base, and the front end 120 of the normalized assembly zone of the bindings, i.e., the boot support zone. Similarly, the rear end 210 of the stiffener is located between the rear contact point 121, and the rear end 122 of the normalized assembly zone of the bindings, or the boot support zone. Thus, if the base 1 has a length "L1" in contact with snow, the stiffener 2 has a length "L2" such that "L2" is less than "L1".

As an example, length "L2" of the stiffener is comprised between 50% and 100% of the length "L1". Moreover, the relative longitudinal position of the stiffener 2 with respect to the base 1, may be for example, such that the middle 211 of stiffener 2 is at the level of the middle 123 of the contact length "L1" of base 1 with the snow. But, it may also be otherwise; thus, the middle 211 of the stiffener 2 may be more in front (AV) or more at the rear (AR) with respect to the middle 123 of the base.

Figure 2:
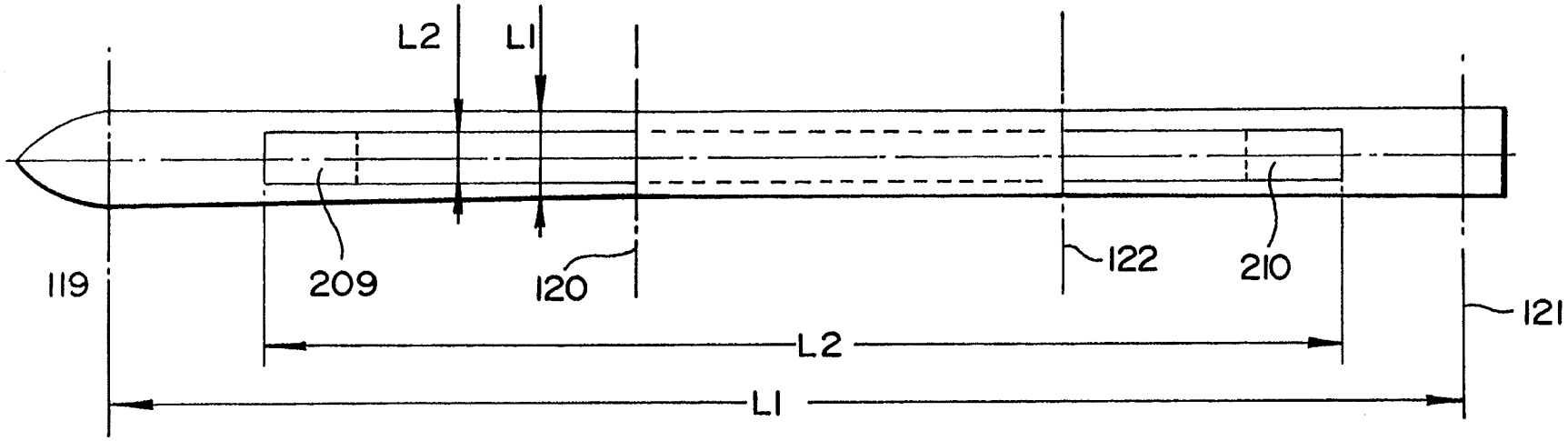
FIG. 2 is a top view of FIG. 1.
Figure 3:
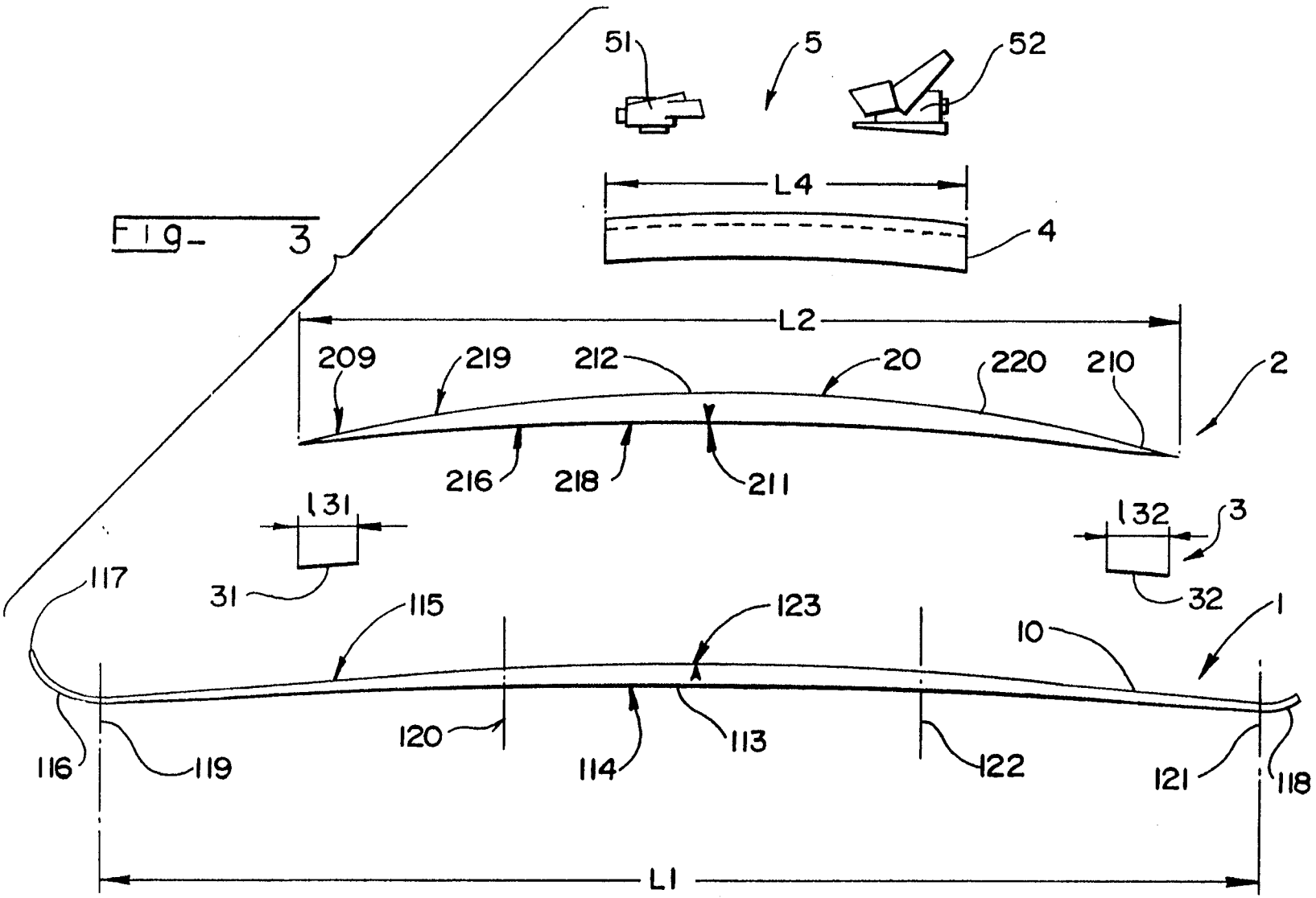
FIG. 3 is a lateral view illustrating the different components of the ski according to the first embodiment.

Insofar as the width of the two elements is concerned, the stiffener 2 may have width "L2" less than the width "L1" of the base 1, and be, as such, narrower than the latter, as is schematically represented in FIGS. 2, 5, and 6.

It may also be noted that the width of the two assemblies base 1 and/or stiffener 2, may be constant or variable.

The base 1 and stiffener 2 are elongated portions, whose height are "h1" and "h2" respectively. Of course, in a transverse section, the two heights "h1" and "h2" may have the same value, but may also be different. Thus, in a transverse section, "h1" may be greater or less than "h2". Moreover, "h1" and/or "h2" may be constant in accordance with the longitudinal position at which the measurement is made. However, to obtain a good distribution of rigidity, it is advantageous to vary either one or the other of heights "h1" or "h2", and even both "h1" and "h2". Advantageously, the height "h1" of the base, and the height "h2" of the stiffener decreases towards the front and towards the rear as is represented in the drawings.

According to another characteristic of the invention, the stiffener 2 is connected to base 1 by connecting means 3, such that the connection between the two elements is either partially flexible and/or partially rigid.

The embodiment represented in FIGS. 1–6, represents an example in which the connection 3 between the two assemblies base 1 and stiffener 2 is partially flexible, and extends only under front end 209 and rear end 210 of the stiffener. To this end, the connection means 3 are embodied by two flexible interfaces 31 and 32. A first front flexible interface 31 of width "L31" and a second rear flexible interface 32 of width "L32" being located respectively under the front end 209 and rear end 210 of the stiffener.

The interfaces 31 and 32 are achieved by a layer of a flexible material of the elastic type, and especially of the viscoelastic type, which is adhered or welded on the one hand, on the upper surface 115 of base 1, and on the other hand, beneath the lower surface 216 of the stiffener. The material used may be elastic with a shore hardness A of 10 to 85, or be a viscoelastic material with an elasticity modulus of 15 to 160 megapascals with a Shore Hardness A of 50 to 95, and a shock absorption value of 0.13 to 0.72. Of course, this data only represents an example of the embodiment, for measurements taken at 20° C. and at frequencies of 15 Hz.

The fixing of the interfaces 31, 32 on base 1, and stiffener 2 is done, for example, by a thermohardenable resin of the polyester epoxy, vinylester or polyurethane type, or of a thermoplastic film or by any other means.

According to the invention, the ski comprises at least one support 4 adapted to receive the binding(s) 5 for the retention of the boot of the skier. The support 4 has the shape of a stirrup (FIG. 6), in the shape of an inverted "U", and comprises an upper wall 40 extending laterally and downwardly by two sidewalls 41, 42 to constitute a lower housing 43 in the shape of a hollowed section extending longitudinally, adapted for the passage of stiffener 2. It must be noted that the dimensions of the housing, both the horizontal dimensions "e4" and vertical dimensions "h4" are greater than the horizontal dimensions "e2" and vertical dimension "h2" of the stiffener, so as to form a space "e" necessary for the release of the latter.

According to a characteristic of the invention, the stiffener does not directly receive stresses from the skier. Thus, the support or stirrup 4 only rests on base 1.

To this end, the lower ends 44 and 45 of the sidewalls of the support are connected to the upper surface 115 of the base 1. Advantageously, the connection between the support and the base is rigid, and obtained, for example by adhesion, by welding or any other means, such as mechanical means.

The support 4 thus constitutes the mechanical element for transmission or distribution of stresses from the skier on the base.

As can be seen from FIG. 6, the stiffener 2, at least in the support zone 4, has a width "e2" less than the width "e1" of the base, so as to enable the passage and the maintenance of the sidewalls of the support on the upper lateral edges 125, 126 of the base.

FIG. 8 represents a top plan view of an embodiment, according to which the stiffener 2 comprises, in its central zone 212, a reduction of width, so as to form two lateral undercuts 213, 214 extending along a reduced length "L'2" less than "L2". The stiffener 2 thus comprises a reduced width central portion.

Figure 9:
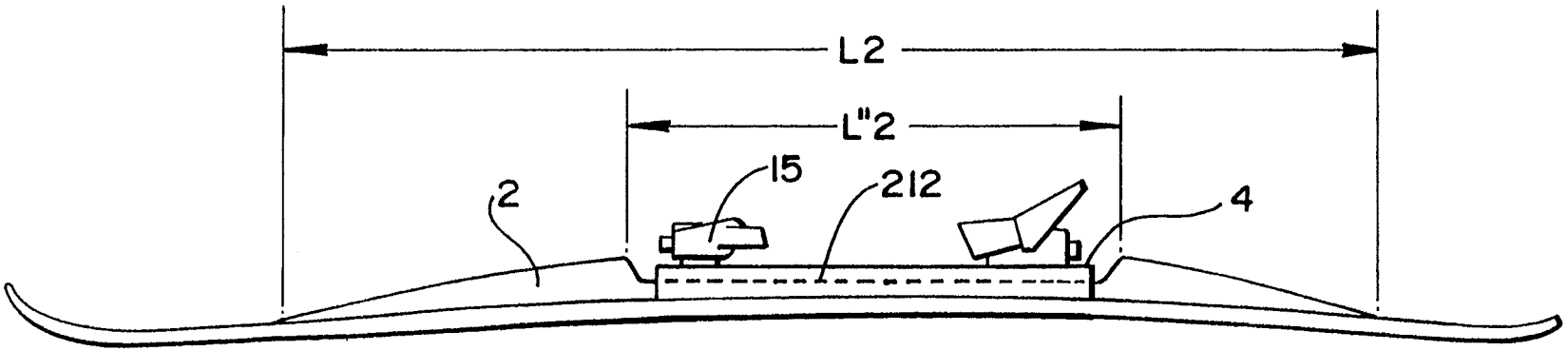
FIG. 9 is a longitudinal side elevation view of the ski according to a variation of FIG. 1.

FIG. 9 represents a longitudinal view in side elevation of another variation, according to which the stiffener 2 comprises, in its central zone 212 a reduction in thickness extending along a reduced length L"2 less than L2. The undercut thus formed enables the reduction of the height of support 4, and consequently, advantageously reduces the height of bindings 5 with respect to the snow.

Figure 10:
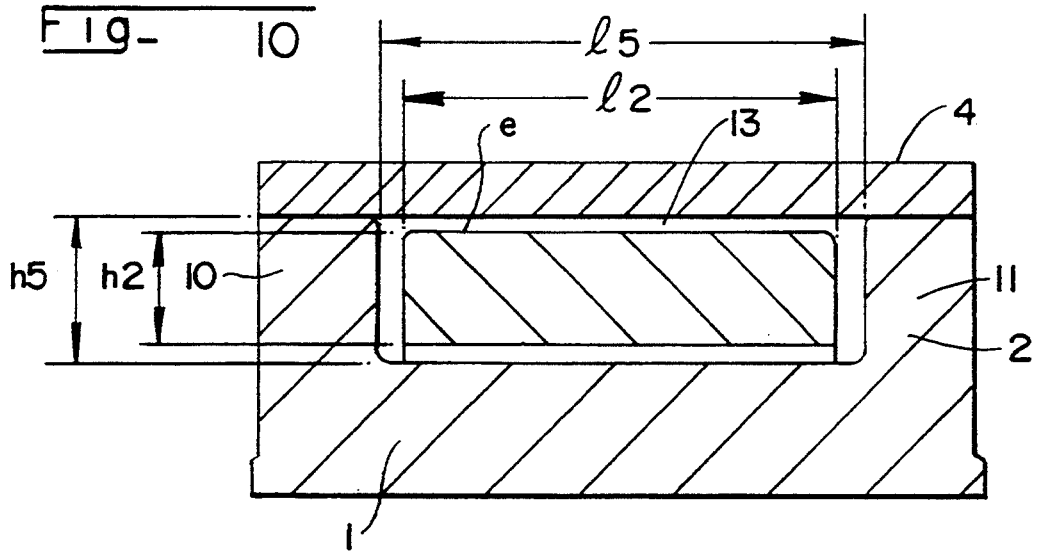
FIG. 10 is a simplified transverse sectional view according to a variation of FIG. 6.
Figure 11:
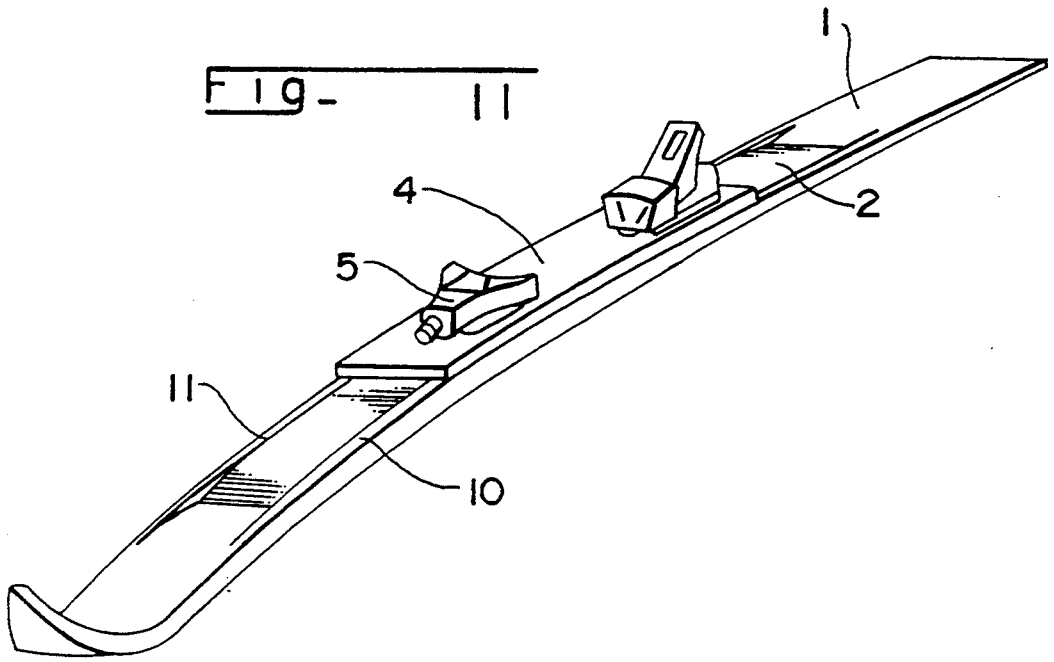
FIG. 11 is a perspective view of the embodiment of FIG. 10.

FIGS. 10 and 11 are variations in which the stiffener 2 is integrated in base 1 with an aim to protecting it. For this, base 1 extends on each side by lateral edges 10, 11 creating a housing 13 adapted for the passage of stiffener 2. The dimensions of the housing, width "e5" and height "h5" are of course greater than the width "12" and height "h2" dimensions of the stiffener to form a space "e" as in the preceding cases. Support 4, in this case is thus like a simple plate affixed to the upper surfaces of the lateral edges 10, 11 of base 1.

According to the embodiment represented in FIGS. 1–6, the central portion of the lower surface 216 of the stiffener is not connected to the base. This non-fixed zone is localized at the level of the support 4, and one can even allow a play "e1" between the lower surface of the stiffener and the upper surface of the base. The stiffener being free between points A and B separating the two interfaces 31, 32.

According to the embodiment of FIGS. 1–7, support 4 receives the front binding 51 in the front, and extends towards the rear along a length "L4" under the rear binding 52. The rear binding 52, commonly called a heel attachment, is itself fixed on the rear portion of the support 4.

FIG. 12 represents a variation according to which the ski consists of two supports 4 spaced from the one another, the first front support 4*a* on which the front abutment 51 is fixed for retention of the boot, and a second support or rear support 4*b* on which the heel attachment 52 is fixed.

The support 4, 4*a*, 4*b* may be an element injected with a plastic material, or a metallic section, an extruded or pultruded plastic element.

Of course, support 4, 4*a*, 4*b* may be of a single integral element, or be constituted of different elements, and may even be constituted of a part of the corresponding binding 5, 51, 52.

It must also be noted that the connection 6 between support 4, 4*a*, 4*b* and the base may be rigid as has been described previously, but may also be flexible. FIGS. 13 and 14 represent such a variation in which the connection is done by an interface 60 made of a flexible material.

The connection 6 may also be of a slide type, in order to enable the possible longitudinal sliding of the support 4 with respect to base 1. This longitudinal sliding enabling, for example, the adjustment and latching of the binding in the chosen position, or even enabling sliding against the action of a spring, as is usual, and well-known in heel attachments for retention of the heel of a boot.

Figure 16:
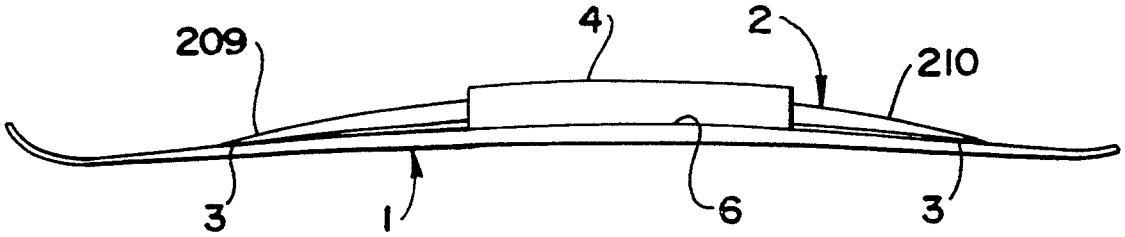
FIG. 16 is another embodiment represented in a lateral view.

It must also be noted that the connection 3 between the stiffener 2 and base 1 may be flexible as described in the previous embodiments, but it also may be rigid as has been represented in FIG. 16. According to this variation, the front and rear ends 209, 210 of stiffener 2 are affixed, in a rigid manner, to the upper surface of base 1 so as to leave the central zone free. This rigid connection 3 may be obtained by any means such as adhesion, mechanical connection such as screws or rivets or even by welding, especially ultrasound or vibration welding.

Thus, the rigidity of the stiffener may be less or equal to that of the base.

Also, that space "e" (FIG. 6) between support 4 and stiffener 2 may be filled by a very flexible foam to stop the formation of ice.

The boot of the skier directly or indirectly rests on support 4. However, the boot held laterally and vertically by its corresponding binding may be supported on the top of the stiffener.

Figure 17:
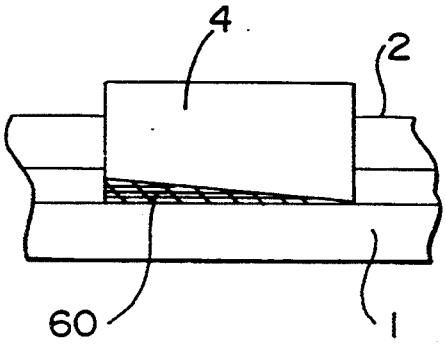
FIGS. 17 and 18 are views similar to FIG. 13, representing two variations of the embodiment.
Figure 18:
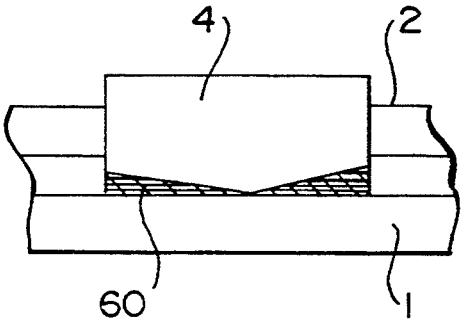

FIGS. 17 and 18 show variations in which the flexible interface 60 connecting the support to the base, has a thickness that is not constant. In the variation of FIG. 17, the thickness increases towards the front, but it may equally well increase towards the rear. In the variation represented in FIG. 18, the interface increases in thickness both towards the front and towards the rear.

FIGS. 19 to 22 show other embodiments according to which the stiffener 2 is linked to the base by its front and rear ends 209, 210 by retention means constituted of intermediate retention elements 90, 91 ensuring its vertical and lateral retention.

Figure 19:
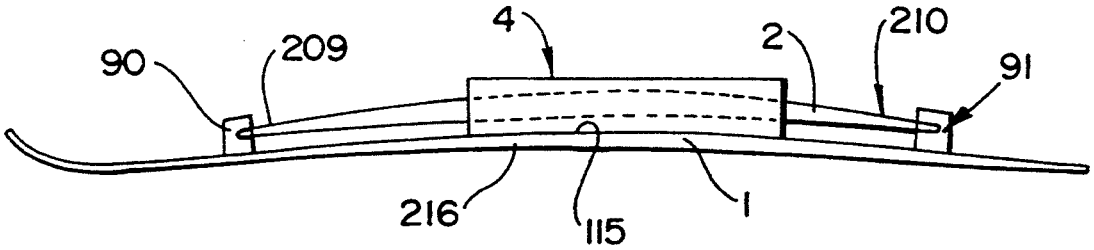
FIGS. 19, 20, 21, and 24 are lateral views illustrating variations.
Figure 20:
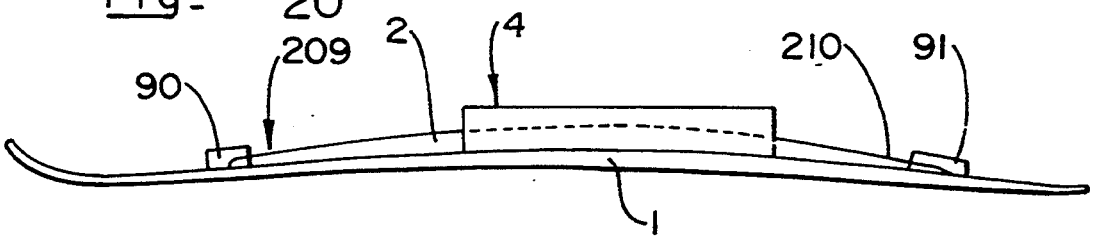

According to the variation of FIG. 19, the lower surface 216 of the stiffener 2 is not in direct contact with the upper surface 115 of base 1, whereas in the embodiment of FIG. 20, there is contact.

In the first case, increasing the height has the effect of increasing the torque exercised by the stiffener on the base in the area of retention elements 90, 91; this consequently increases pressure of the base on the snow. One can also envision prestressing the stiffener tending to increase the torque by using a stiffener constituted of a wing that would be maintained in its central portion by guiding means for example.

Figure 21:
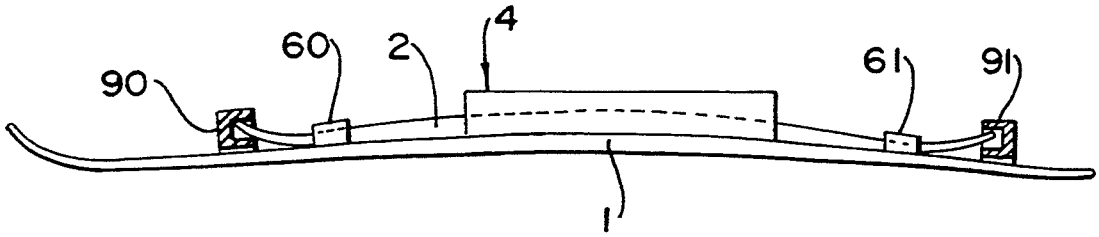

This embodiment has especially been represented in FIG. 21. The stiffener is constituted of a wing 2 prestressed in abutment on the retention means, and is guided by several guiding means 4, 60, 61 spaced along the ski and fixed to the base. Retention means 90, 91 can be provided to be adjustable longitudinally so as to be able to make the prestress of the wing react (adjustment not represented).

Figure 22A:
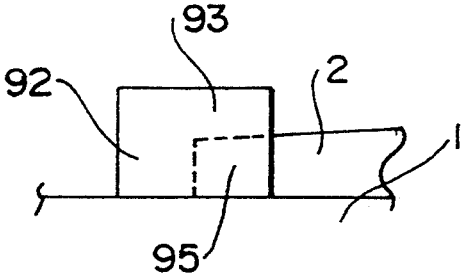
FIG. 22*a* shows a detail of the embodiment of FIG. 20.
Figure 22B:
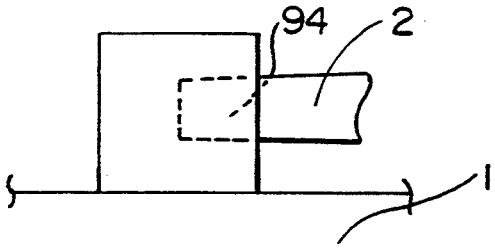
FIG. 22*b* shows a detail of the embodiment of FIG. 19.
Figure 22C:
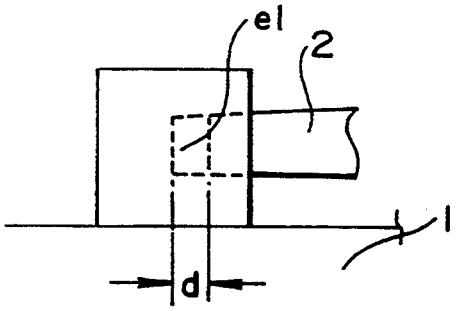
FIGS. 22*c* and 22*d* are similar views representing two variations.
Figure 22D:
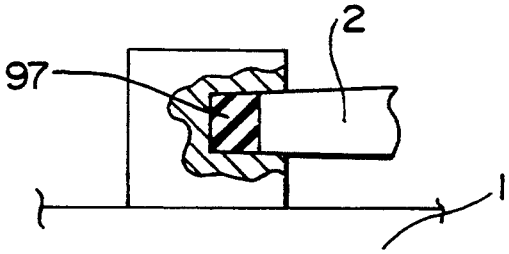

The retention means 90, 91 are each constituted of at least one transverse wall 92 extending upwardly, and one horizontal wall 93 extending towards the center of the ski to constitute a lower housing 94 open in the direction of the center of the ski and closed laterally by two side walls 95, 96 for lateral retention. The ends 209, 210 of the stiffener are engaged and retained in the lower housing 94. One can block the two ends in their corresponding housing or block only one of the ends 209 or 210 and enable the displacement of the other 210 or 209 in its corresponding housing, as has been represented on FIGS. 22*c* and 22*d*. In FIG. 22*c*, the play "e1" enables the displacement "d" of the corresponding end of the stiffener. But relative longitudinal displacement may also be done against the action of an elastic system 97, as has been represented in FIG. 22*d*.

Figure 22E:
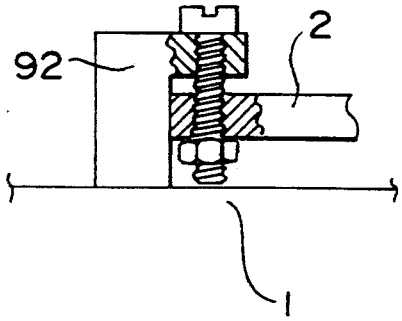
FIGS. 22*e* and 22*f* show a detail according to the variations of FIG. 19 or 21.

FIG. 22*e* represents an example in which the height of the stiffener may be adjusted by any means such as screwing or any other means.

Figure 22F:
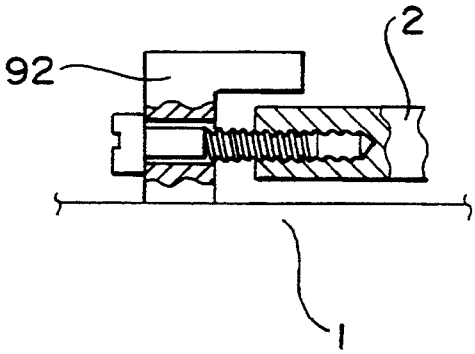
Figure 23:
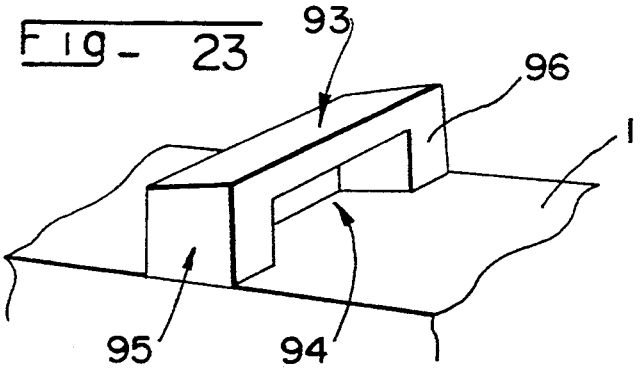
FIG. 23 shows a detail of the embodiment of FIG. 20 in perspective.

FIG. 22*f* represents an example in which the stiffener may be prestressed longitudinally by a longitudinal screwing means for example.

Figure 24:
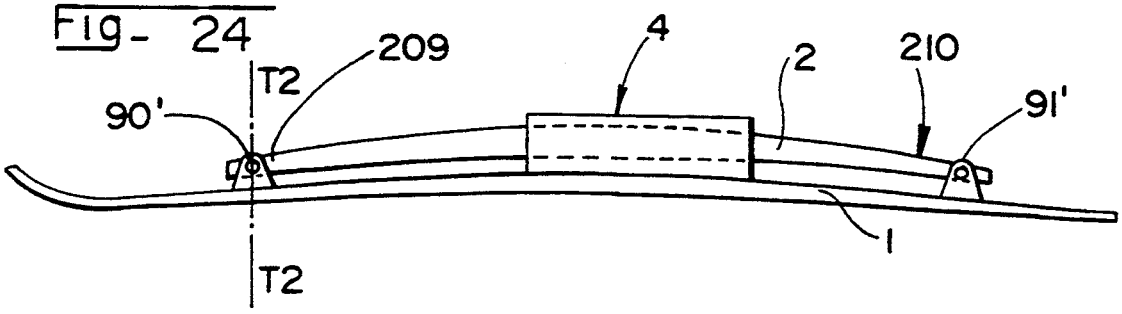
Figure 26:
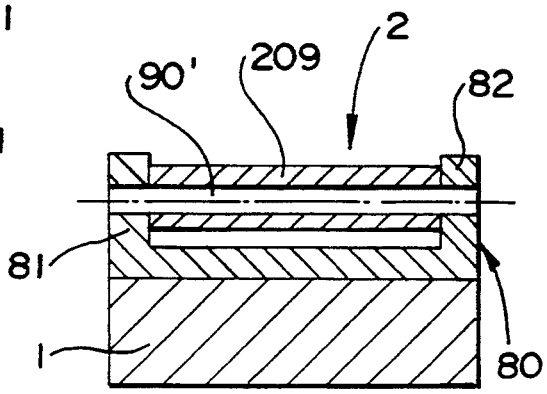
FIG. 26 is a transverse sectional view along T2 of FIG. 24.

The longitudinal and vertical retention means 90, 91 may also be constituted of journal systems 90', 91' as has been represented on FIGS. 24 and 26. Thus, the front 209 and rear ends 210 of the stiffener 2 are connected at base 1 by a transverse journal axis 90, 91, the journal 90', 91' being retained at base 1 by a journal support 80 comprising two retention sidewalls 81, 82.

Figure 25:
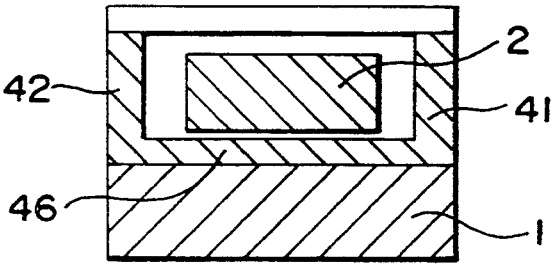
FIG. 25 is a simplified transverse sectional view similar to FIG. 6, representing a variation.

The stirrup 4, 4*a*, 4*b* represented previously, has the general shape of an inverted "U", but may also have any other shape, as for example, has been shown in FIG. 25. According to this variation, stirrup 4 is made of an element having the general shape of a "U" whose transverse wall 46 is arranged between the stiffener 2 and its base 1.

FIGS. 27–30 show a variation of the embodiment of the support 4*a*, 4*b*. According to this variation, this support is constituted of two different materials: the first portion 161 of a material M1, for example rigid, and a second portion 162, of another material M2, for example more flexible. The rigid portion 161 comprises a horizonal portion 163 and two lateral portions 164, the flexible portion being arranged beneath the horizontal portion and located beside the center of the ski.

Figure 27:
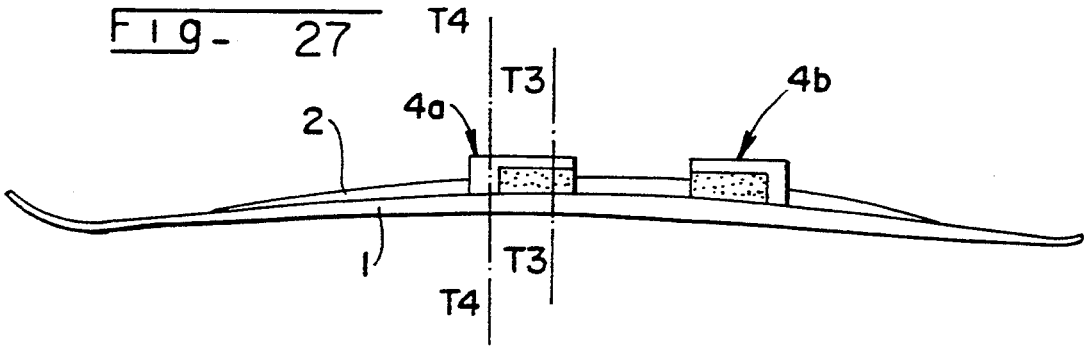
FIGS. 27–30 represent a variation of embodiment of the supports.
Figure 28:
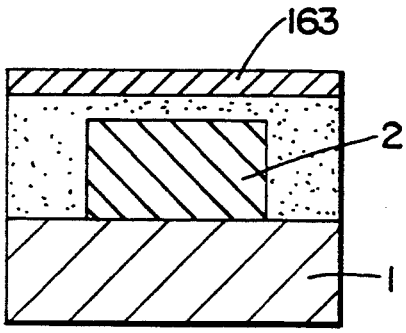
Figure 29:
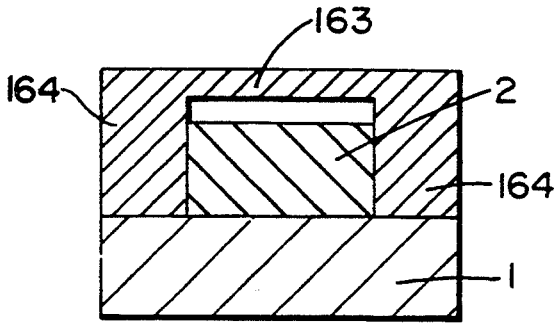
Figure 30:
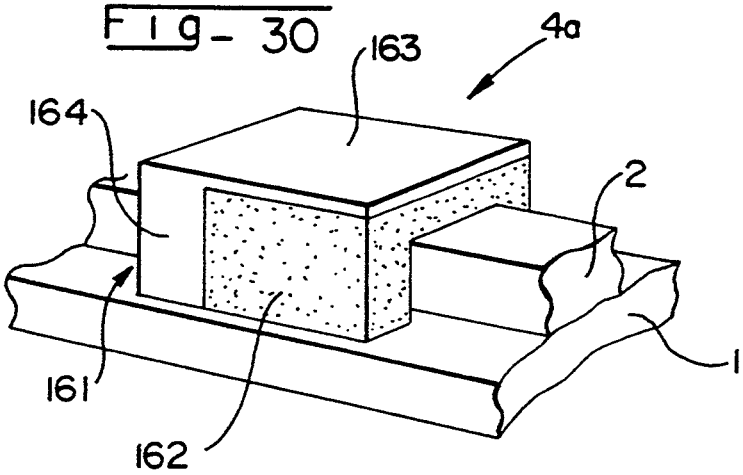
Figure 31:
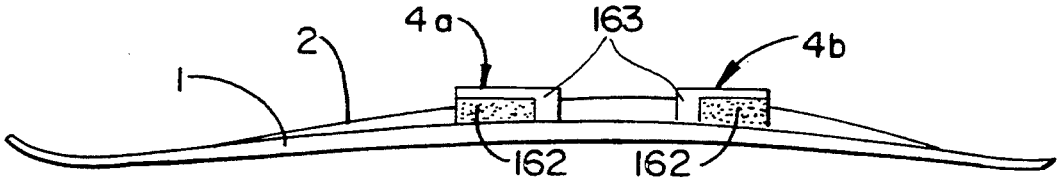
FIG. 31 is a view similar to FIG. 27 showing a variation.

FIG. 31 is a view similar to FIG. 27 showing a variation according to which the flexible portions 162 are not turned towards one another towards the center of the ski, but turned towards the sides of the front and rear ends of the ski.

Figure 32:
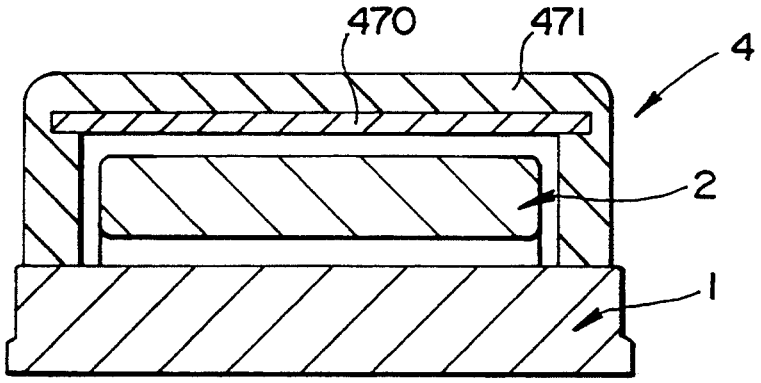
FIGS. 32–34 show two variations of the invention, especially of the support.
Figure 33:
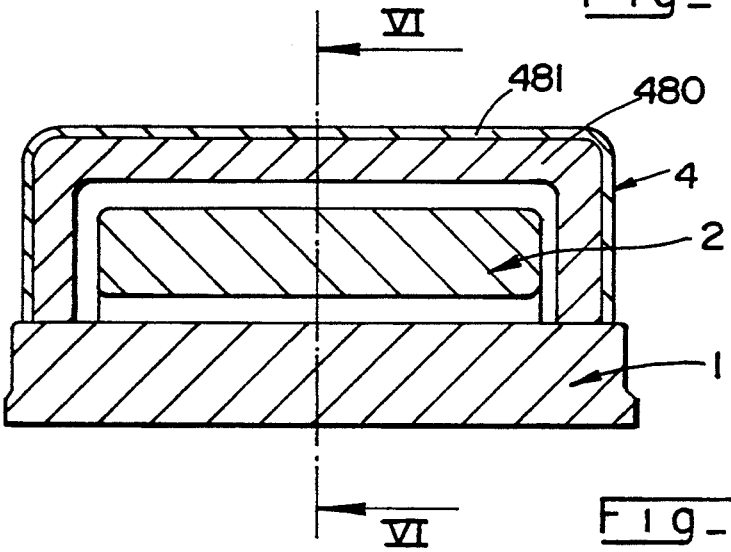
Figure 34:
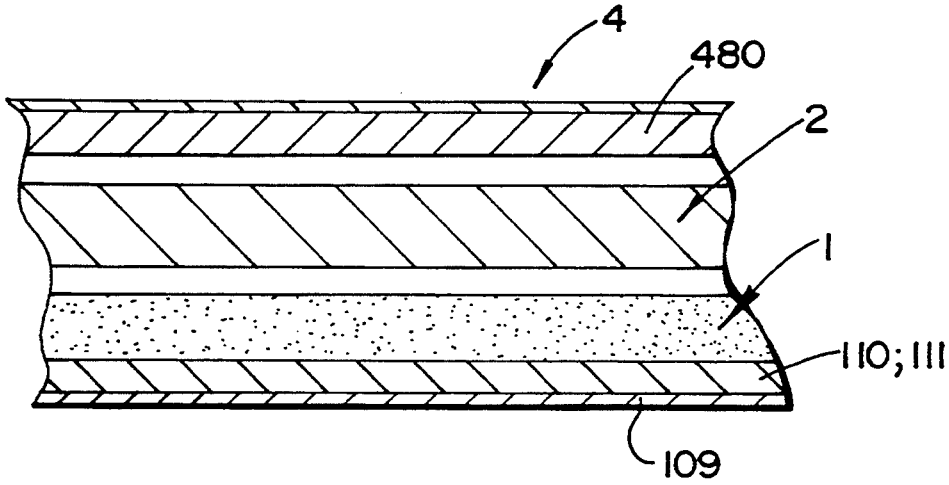

FIGS. 32–34 illustrate a variation of the embodiment of the invention in which the support 4 comprises one or several reinforcement layers so as to round off the stiffness characteristics of base 1. Such a construction may be useful, especially when one wishes to reduce the height of the base/support assembly, and at the same time retain adequate mechanical characteristics.

FIG. 32 illustrates an example in which the stirrup is equipped with a reinforcement insert 470 having the shape of a plate inserted in a shell 471 in the shape of an inverted U. The insert may be a metallic plate made of an aluminum alloy for example, or a plate made of composite material. The support 4 may be obtained by injection molding of the shell 48 with a plastic material. In this case, one can of course provide that the insert be affixed to the shell during injection.

FIG. 33 illustrates an example in which the stirrup is constituted of a reinforcement shell 480 in the shape of an inverted U on which a decor layer 481 is affixed. The reinforcement shell 480 may be made of one or several layers of composite materials of any type as seen previously for the constitution of the reinforcement base layers.

Also, the decor layer 481 may be of a plastic material such as polyamide or any other material.

FIG. 34 illustrates the internal structure of the ski according to the invention, in the zone of the extension of the support 4.

In this case the structure of base 1 comprises, among others, a sliding layer 109, lower reinforcement elements 110, 111, a core 105. The upper reinforcement elements do not cover the core, contrary to the example of FIG. 6, and are replaced by the reinforcement element 480 of support 4.

Of course, support 4 may be extended more generally beyond the assembly zone of the bindings, and this may be especially advantageous in cases where its function is not only that of having to transmit the stresses of the skier on the base, but also that of intervening in the distribution of rigidity along the ski.

Figure 35:
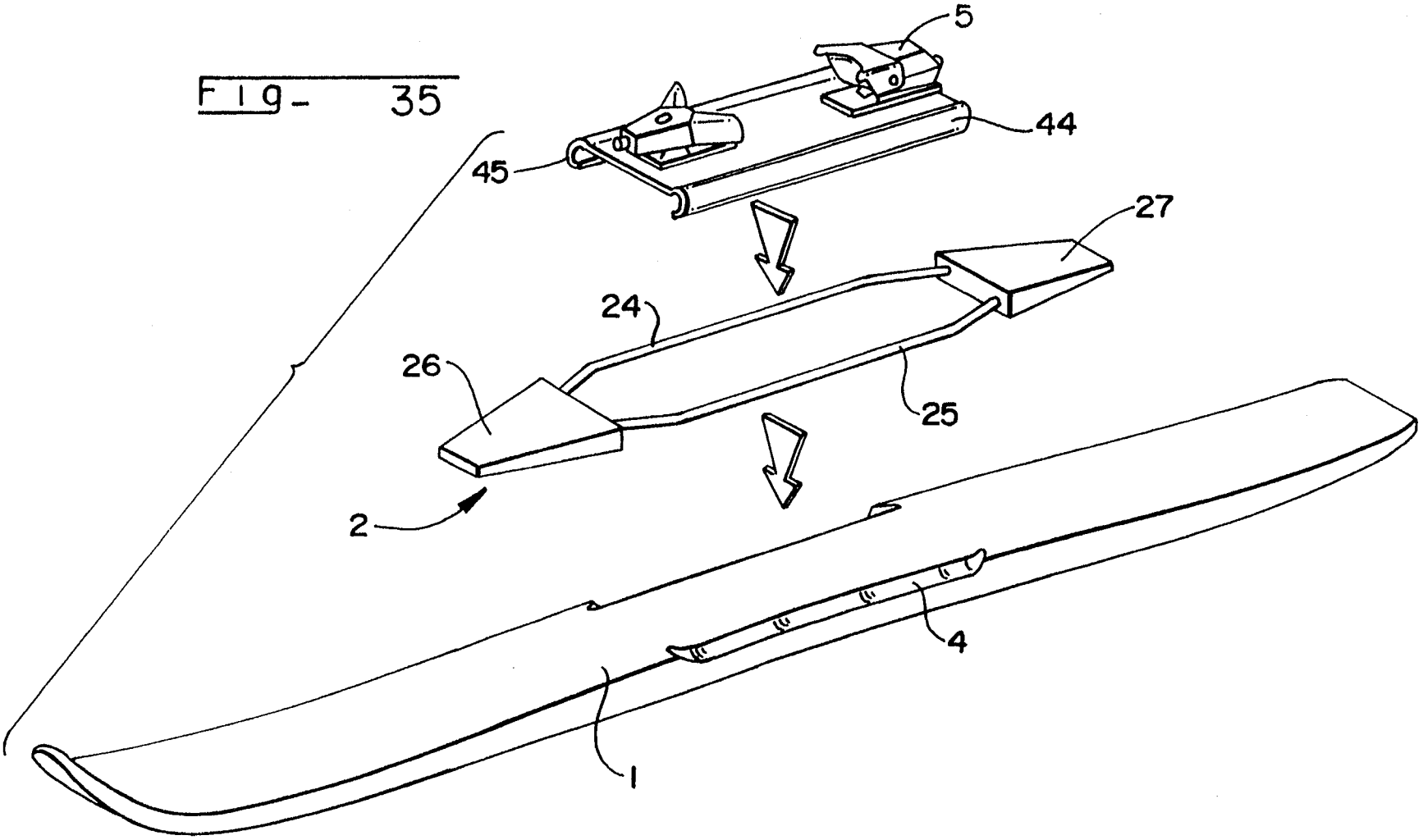
FIGS. 35–37 respectively represent a perspective, a transverse sectional, and a planar view of a variation of the invention, and especially of the support and the stiffener.
Figure 36:
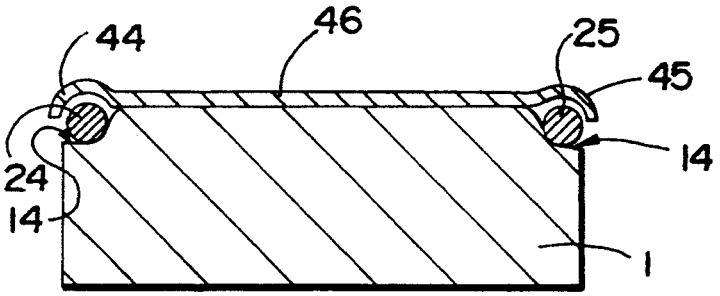
Figure 37:
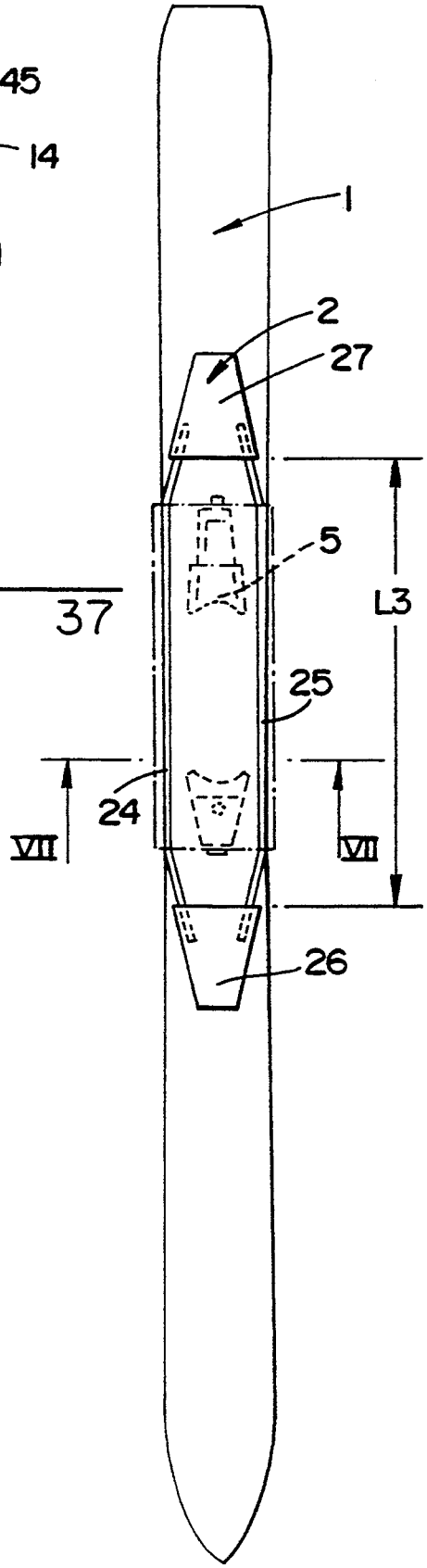
Figure 38:
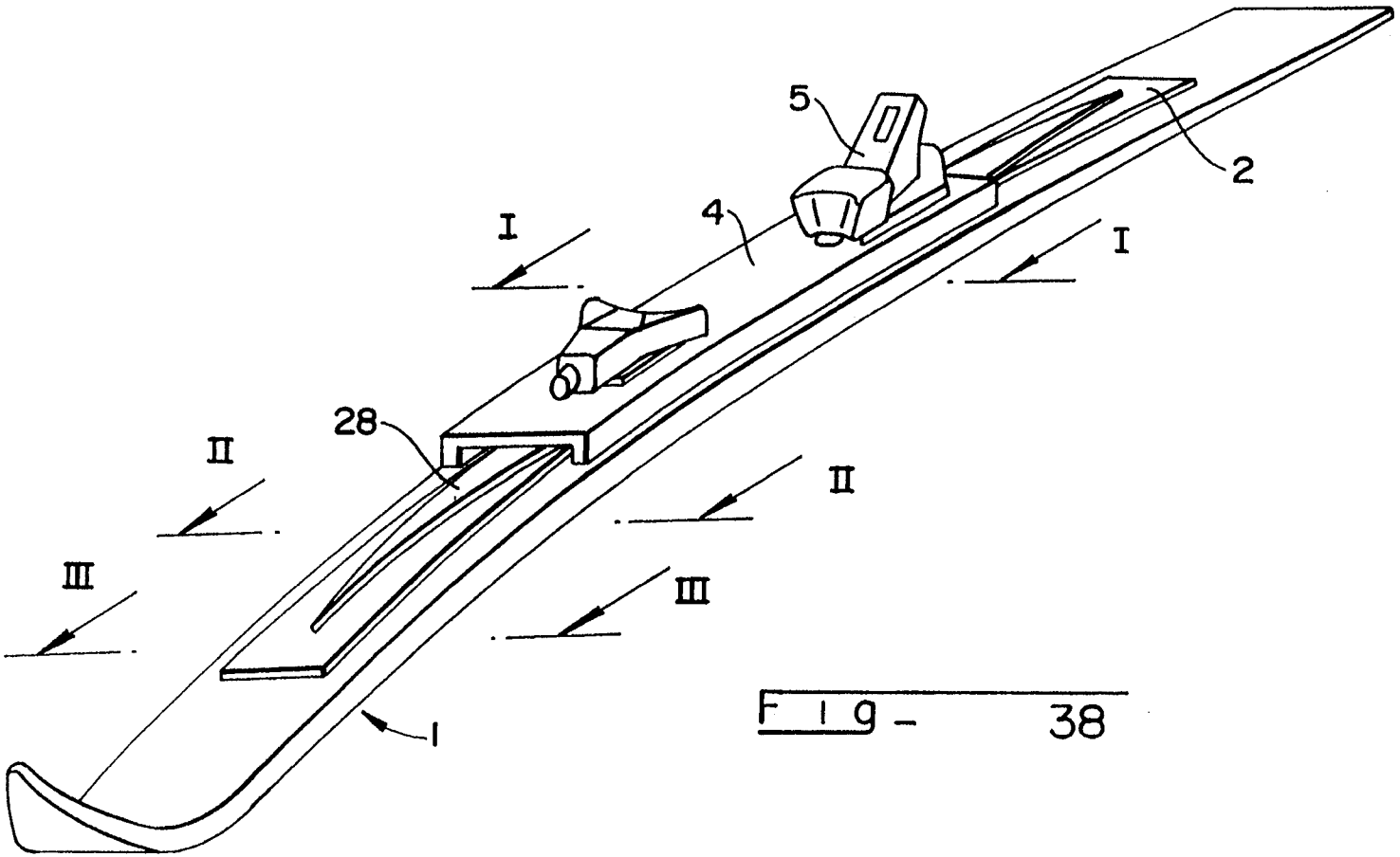
FIG. 38 represent in perspective, a ski according to a variation of the invention, especially of the stiffener.

FIGS. 35 to 37 illustrate an embodiment in which the stiffener has a special conception so as to limit the space required by it, and thus, so as to reduce the height of the bindings with respect to the snow. This height reduction especially enables better efficiency of the use of the ski brakes.

The stiffener 2, in this case, is composed of two central sections 24, 25, of a useful length L3 at least equal or greater than the length of the zone provided for the assembly of bindings 5.

Also, the sections are spaced from another at a distance 13 adequate for the width of the bindings 5.

The front and rear coupling elements 26, 27 enable the static connection of each of the ends of sections 24, 25.

Each of these elements 26, 27 is fixed by a rigid connection or a flexible connection to base 1 of the ski.

The stirrup 4 has the general shape of a plate equipped with lateral edges 44, 45 partially or totally covering the sections and thus enabling their retention in case each of them buckle laterally. The stirrup, on the other hand, is directly connected to the base in its central portion 46 by any connecting means.

The sections may be eventually laterally integrated, either partially or totally, in housings 14 of the base of a complementary shape, so as to optimize the space required by them.

The sections are preferably made of a composite material by pultrusion and assembled by molding, adhesion or any other means to coupling elements 26, 27. The latter may be of any type, shape or structure. They can be constituted especially of any reinforcement material made of thermohardenable resin and fibers for example.

Figure 39:
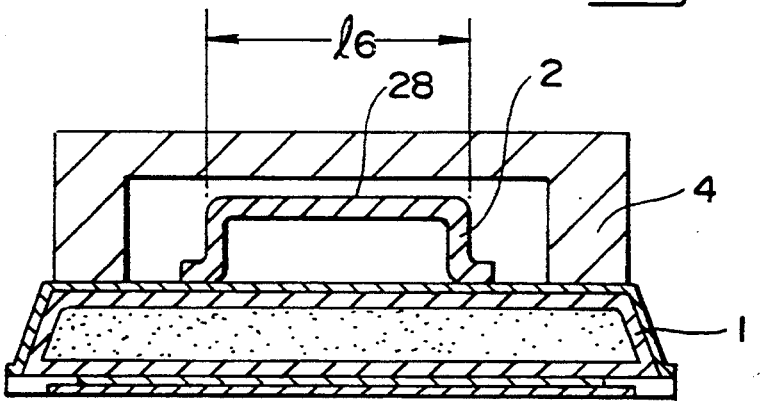
FIG. 39 represents a sectional view of the ski of FIG. 38 along I—I.
Figure 40:
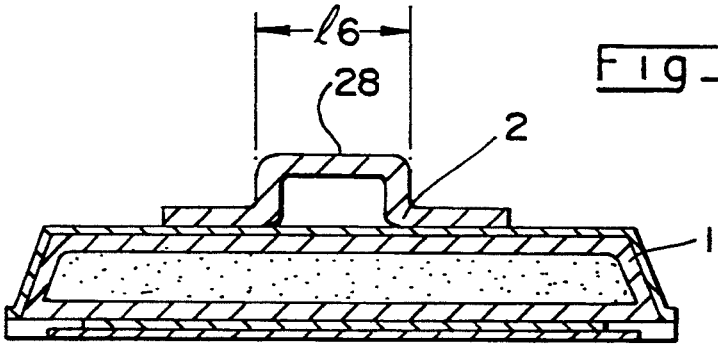
FIG. 40 represents a sectional view of the ski of FIG. 38 along II—II.
Figure 41:
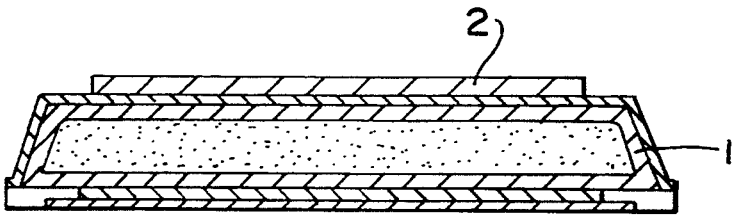
FIG. 41 represents a sectional view of the ski of FIG. 38 along III—III.

FIGS. 38–41 represent a preferred embodiment of the invention in which the stiffener is constituted by a reinforced section whose shape changes longitudinally. As can be seen from FIG. 41, the stiffener has the shape of a flat plate in the vicinity of its ends and then has a central rib 28 whose width "e6" increases progressively in the direction of the median zone of the stiffener, as is shown in FIGS. 39 and 40. This changing shape especially enables the actual rigidity of the stiffener to be varied in accordance with the considered longitudinal position. It has, in effect, greater rigidity at the center, which progressively decreases towards the ends, and thus plays the same role as a stiffener whose thickness curve and section varies along the ski. This embodiment has the advantage, with respect to those described previously, of being easily implemented by the TRE technique (Reinforced Stampable Thermoplastic), SMC (Sheet Molding Compound) or by pultrusion, for example. The section may be covered by a superficial layer adapted to protect it and to possibly be decorated (not represented).

The instant application is based upon French patent applications 90.16048 of Dec. 14, 1990 and 91.05012 of Apr. 16, 1991, the disclosures of which are hereby expressly incorporated by reference thereto, and the priorities of which are hereby claimed.

The invention disclosed herein is not limited to the specific embodiments described and illustrated herein, such embodiments merely representing examples of the invention, but also includes all equivalents, combinations, and other variations which are also contemplated within the scope of the invention as defined by the following claims.

What is claimed is:

1. A ski comprising:

a first lower assembly comprising a base, said base having a front end raised to form a spatula;

a second upper assembly comprising a single stiffener, said stiffener having a front end and a rear end;

a connection for connecting each of said front end and said rear end of said stiffener to said base; and at least one support connected to said base, said at least one support being adapted to receive the bindings, independent of said stiffener, in a boot support zone, for maintaining the boot on the ski, wherein said single stiffener extends through said boot support zone; and said single stiffener is connected to said base along said predeterminate length of said stiffener only at each of said front end and said rear end of said stiffener.

2. Ski as defined by claim 1, wherein the stiffener has length "L2" less than "L1" of the surface of base in contact with the snow.

3. Ski as defined by claim 2, wherein the length "L2" of the stiffener is comprised between 50% and 100% of the length "L1".

4. Ski as defined by claim 3, wherein the front end of the stiffener is located between the contact zone of the spatula of the base and the front end of the assembly zone of the bindings.

5. Ski as defined by claim 3, wherein the rear end of the stiffener is located between the heel contact zone of the base and rear end of the assembly zone of the bindings.

6. Ski as defined by claim 1, wherein the middle of the stiffener is located at the level of the middle of the base zone in contact with the snow.

7. Ski as defined by claim 1, wherein the middle of stiffener is located in front of the middle of the base zone in contact with the snow.

8. Ski as defined by claim 1, wherein the middle of stiffener is located at the rear of the middle of the base zone in contact with the snow.

9. A ski comprising:

a first lower assembly comprising a base, said base having a front end raised to form a spatula;

a second upper assembly comprising a single stiffener, said stiffener having a front end and a rear end;

a connection for connecting each of said front end and said rear end of said stiffener to said base; and at least one support connected to said base, said at least one support being adapted to receive the bindings, independent of said stiffener, in a boot support zone, for maintaining the boot on the ski, wherein said single stiffener extends through said boot support zone;

said single stiffener is connected to said base along said predetermined length of said stiffener only at each of said front end and said rear end of said stiffener; and in a zone at which the boot is supported, the width "l2" of the stiffener is less than the width "l1" of the base.

10. Ski as defined by claim 9, wherein the height "h1" of the base and the height of the stiffener "h2" is constant.

11. Ski as defined by claim 9, wherein the height "h1" of the base and the height of the stiffener "h2" is variable.

12. Ski as defined by claim 11, wherein the height "h2" of the stiffener decreases towards the front.

13. Ski as defined by claim 11, wherein the height "h2" of the stiffener reduces towards the rear.

14. Ski as defined by claim 1, wherein the base and the stiffener is a beam of an elongated shape.

15. Ski as defined by claim 14, wherein the base is a beam constituted by a core arranged between two reinforcements, the first upper reinforcement and second lower reinforcement, and comprises a sliding layer comprising laterally two lateral metallic running edges, said upper reinforcement being covered at least partially by a superficial layer.

16. Ski as defined by claim 15, wherein the superficial layer of the base is interrupted at the level of the stiffener.

17. Ski as defined by claim 14, wherein the stiffener is a beam constituted by a core arranged between two reinforcements, a first upper reinforcement and second lower reinforcement, said upper reinforcement being covered by a superficial layer.

18. Ski as defined by claim 1, wherein the ends of stiffener are connected to base by transverse journal axes.

19. Ski as defined by claim 18, wherein the ends of the stiffener are retained on base by longitudinal, lateral and vertical retention means.

20. Ski as defined by claim 1, wherein the connection is of the flexible type.

21. Ski as defined by claim 20, wherein the flexible connection is implemented by two interfaces, a first front flexible interface arranged beneath the front end of the stiffener and a second rear flexible interface arranged beneath the rear end of said stiffener.

22. Ski as defined by claim 21, wherein the interfaces are constituted by a sheet of elastic material.

23. Ski as defined by claim 1, wherein the connection is of the rigid type.

24. A ski comprising:

a first lower assembly comprising a base, said base having a front end raised to form a spatula;

a second upper assembly comprising a single stiffener, said stiffener having a front end and a rear end;

a connection for connecting each of said front end and said rear end of said stiffener to said base; and at least one support connected to said base, said at least one support being adapted to receive the bindings, independent of said stiffener, in a boot support zone, for maintaining the boot on the ski, wherein said single stiffener extends through said boot support zone;

said single stiffener is connected to said base along said predetermined length of said stiffener only at each of said front end and said rear end of said stiffener; and the support has the shape of a stirrup having the shape of an inverted "U", and comprises an upper wall extending laterally and downwardly by two sidewalls to constitute a lower housing having the shape of a hollow section extending longitudinally and adapted for the passage of said stiffener.

25. Ski as defined by claim 24 wherein the dimensions of the housing, both width "l4" and height "h4" are greater than the width "l2" and height "h" dimensions of the stiffener to form a space "e" necessary for release of the stiffener.

26. Ski as defined by claim 25, wherein the support receives the front binding at the front, and extends towards the rear along a length "L4" beneath the rear binding.

27. Ski as defined by claim 1, wherein it comprises two supports spaced from another, the first front support on which a front abutment is fixed for retention of the boot, and a second rear support on which the heel attachment is fixed.

28. Ski as defined by claim 1, wherein the at least one support comprises a single and integral element.

29. Ski as defined by claim 28, wherein the support is constituted by a portion of the corresponding binding.

30. Ski as defined by claim 1, wherein the connection between the support and the base is rigid.

31. Ski as defined by claim 1, wherein the connection between the support and the base is flexible and implemented by an interface made of a flexible material.

32. Ski as defined by claim 1, wherein said connection for connecting said front end comprises a flexible connection.

33. Ski as defined by claim 1, wherein said connection for connecting said front end comprises at least a partially rigid connection.

34. Ski as defined by claim 1, wherein said at least one support comprises a stirrup.

35. Ski as defined by claim 9, wherein the height "h1" of the base is constant.

36. Ski as defined by claim 9, wherein the height "h2" of the stiffener is constant.

37. Ski as defined by claim 9, wherein the height "h1" of the base is variable.

38. Ski as defined by claim 9, wherein the height "h2" of the stiffener is variable.

39. Ski as defined by claim 22, wherein the interfaces are constituted by a sheet of viscoelastic material.

40. Ski as defined by claim 1, wherein the at least one support comprise a plurality of elements.

41. A ski comprising:

a first lower assembly comprising a base, said base having a front end raised to form a spatula;

a second upper assembly comprising a single stiffener, said stiffener having a predeterminate length extending between a front end and a rear end;

a connection for connecting each of said front end and said rear end of said stiffener to said base, said stiffener being movable at least vertically with respect to said base between said front end and said rear end; and at least one support affixed to said base, said at least one support comprising means for receiving the bindings completely, independent of said stiffener, in a boot support zone, for maintaining the boot on the ski, wherein said single stiffener extends through said boot support zone; and said single stiffener is connected partially to said base along said predeterminate length of said stiffener.

42. Ski as defined by claim 41, wherein said at least one support defines an assembly zone for receiving front and rear ski bindings for maintaining the boot on the ski, said assembly zone having a length greater than a length of the boot.

43. Ski as defined by claim 41, wherein, between said front end and said rear end of said stiffener, a space is provided between a lower surface of said stiffener and an upper surface of said base and wherein said at least one support is rigidly affixed to said base.

44. A ski comprising:

a first lower assembly comprising a base, said base having a front end raised to form a spatula;

a second upper assembly comprising a stiffener, said stiffener having a front end and a rear end;

a connection for connecting said front end and said rear end of said stiffener to said base;

at least one support connected to said base, said at least one support being adapted to receive the bindings, independent of said stiffener, for maintaining the boot on the ski, wherein in a zone at which the boot is supported, the width "l2" of the stiffener is less than the width "l1" of the base, and the height "h1" of the base is variable.

* * * * *